US006962016B1

(12) United States Patent
Meyer

(10) Patent No.: US 6,962,016 B1
(45) Date of Patent: Nov. 8, 2005

(54) PICTURE FRAME AND HANGER

(76) Inventor: James F. Meyer, 26776 Nile Rd., Stover, MO (US) 65078

( * ) Notice: Subject to any disclaimer, the term of this patent is extended or adjusted under 35 U.S.C. 154(b) by 0 days.

(21) Appl. No.: 10/676,653

(22) Filed: Oct. 2, 2003

(51) Int. Cl.[7] ..... A47G 1/16
(52) U.S. Cl. ..... 40/757; 40/700
(58) Field of Search ..... 40/757, 761, 764, 40/700

(56) References Cited

U.S. PATENT DOCUMENTS

| | | | | |
|---|---|---|---|---|
| 990,067 | A * | 4/1911 | Scott | 434/417 |
| 2,299,443 | A | 10/1942 | Walmsley | |
| 3,254,438 | A * | 6/1966 | Filary et al. | 248/467 |
| 3,294,355 | A | 12/1966 | Topf | |
| 4,083,525 | A | 4/1978 | Rath | |
| 4,228,982 | A * | 10/1980 | Sellera | 248/467 |
| 4,530,482 | A * | 7/1985 | Berinson | 248/475.1 |
| 4,712,761 | A * | 12/1987 | Wassell | 248/475.1 |
| 5,605,313 | A | 2/1997 | Erickson et al. | |
| 5,961,090 | A | 10/1999 | Parkin | |
| 6,053,468 | A * | 4/2000 | Francis | 248/475.1 |
| 6,241,210 | B1 | 6/2001 | Brindisi | |
| 6,286,802 | B1 | 9/2001 | Munson et al. | |
| 2002/0166939 | A1 | 11/2002 | Plein | |
| 2003/0038222 | A1 | 2/2003 | Holmes | |

* cited by examiner

*Primary Examiner*—Gary C. Hoge
(74) *Attorney, Agent, or Firm*—James V. Harmon

(57) ABSTRACT

A picture frame and hanger bar together provide a picture hanging system that requires a single hanger bar in addition to the picture frame itself. The picture frame hanger has a wall mounting surface that during use is affixed to the wall or other vertical surface and the picture frame is provided with a downwardly facing skid member that is recessed within a pocket in the rear of the picture frame. The hanger bar is provided with an upwardly facing ramp surface that is canted downwardly proceeding toward the wall so that when the skid on the picture frame engages the canted surface, the picture frame will slide rearwardly toward the wall on the canted surface so as to press the picture frame against the wall by the force of gravity. The hanger bar preferably applies pressure to a backer board positioned behind the picture or other graphic article for holding it in a flat condition.

10 Claims, 4 Drawing Sheets

PICTURE FRAME AND HANGER

FIELD OF THE INVENTION

This invention relates to a system for hanging picture frames on a wall or other vertical surface.

BACKGROUND OF THE INVENTION

The present invention is useful in the home but is particularly advantageous for use by fraternal organizations, clubs, charitable organizations, churches and hospitals, etc. that often display numerous certificates, awards, photographs, educational degrees, licenses and the like arranged on a wall in rows and columns. In order to provide a good visual impression, the frames must be accurately aligned both horizontally and vertically. If they are out of vertical alignment, cocked to the left or right or are spaced apart differently, they do not present a good appearance. It is thus an important objective of the present invention to provide a system for hanging picture frames and especially multiple picture frames so that they can be easily and reliably aligned both vertically and horizontally as well as being equally spaced apart from one another and for reliably holding them against the wall, most preferably so that the entire rear surface of the frame is in contact with the wall. This assures that all of the frames in any column or row are all positioned vertically and are not tilted away from the wall at various angles and present a solid visual impression.

A related requirement in displaying licenses, degrees, awards, certificates and the like, is the need to change them from time to time. It is especially important where a large number of certificates or awards are displayed that changes can be made easily and quickly so that some of the certificates can be removed simply and replaced whenever required without having to dismantle the frame itself or perform other time consuming operations.

A variety of picture frame hanger systems have been previously proposed as described, for example, in U.S. Pat. Nos. 2,299,443; 3,294,355; 4,083,525; 5,605,313; 5,961,090; 6,241,210; 6,286,802; and publications U.S. 2002/0166939 and U.S. 2003/0038222. These prior systems, although capable of supporting a picture frame so that it will not rock from side-to-side, have various shortcomings. First, a pair of interlocking picture frame elements is required, including a first picture frame hanging element that is attached to the wall, and a second picture frame hanging element that is attached to the picture frame. The requirement for two interlocking picture frame elements doubles the cost of the device. A second problem is that the pictures frames are not held against the wall. As a result, the frames do not present the same stable visual impression as does a picture frame that is pressed solidly against the wall. The frames are also are more difficult to clean and a space exists behind them were dust can accumulate. Most important, however, is that being firmly in contact with the wall creates the impression that the frames are solidly based and even appear to be more a part of the building. Pictures and awards also sometimes wrinkle or warp. Another objective is therefore to automatically maintain the graphic article being displayed under compression.

In view of these and other deficiencies of the prior art, it is thus one object of the present invention to provide an improved system for hanging picture frames which requires only a single hanger element in addition to the picture frame itself.

Another object of the invention is to provide an improved picture frame hanging system that lends itself to hanging multiple frames in evenly spaced columns and rows as well as being spaced equally from one another.

A further object of the invention is to provide in improved picture frame hanging system that inherently holds the frames firmly in contact with the wall in a vertical position to provide a solid and permanent visual impression, as well as to maintain all of the frames upright, i.e., in a vertical position rather than being tilted away from the wall and renders them virtually impossible to move or disturb by casual contact or vibration.

Another object is to maintain the picture under compression so that it will not warp or wrinkle.

These and other more detailed and specific objects of the present invention will be better understood by reference to the following figures and detailed description which illustrate, by way of example, but a few of the various forms of the invention within the scope of the appended claims.

SUMMARY OF THE INVENTION

The present invention concerns a picture frame and hanger therefore that together provide a picture hanging system which in a preferred form requires a single hanger bar or beam in addition to the picture frame itself. The picture frame hanger or supporting bar has a wall mounting surface that during use is affixed to the wall or other vertical surface. The picture frame itself is provided with a downwardly facing skid member that is recessed in a pocket at the rear of the picture frame. The hanger bar is provided with an upwardly facing support surface or ramp that is canted or tilted downwardly proceeding toward the wall so that when the skid on the picture frame contacts the canted surface, the frame will slide rearwardly toward the wall on the canted surface so that the picture frame is pressed against the wall by the force of gravity.

THE FIGURES

DETAILED DESCRIPTION OF PREFERRED EMBODIMENTS

The present invention concerns a combination picture frame and hanger bar device that together provide a picture hanging system that in its preferred form employs a single hanger unit or bar in addition to the picture frame itself. The picture frame hanger or supporting bar has a wall mounting surface that during use is placed against the wall or other vertical surface. The picture frame is provided with a downwardly facing skid member that is recessed within and located at the upper end of a pocket in the rear of the picture frame. The hanger bar is provided with an upwardly facing ramp or supporting surface that is canted downwardly proceeding toward the wall so that when the skid on the picture frame engages the canted surface, it slides under the influence of gravity toward the wall so that the entire picture frame is held against the wall by the force of gravity. In one preferred form of the invention, the weight of the picture frame also compresses the article being displayed through an interaction between the canted supporting surface on the hanger bar, the skid and a backer board placed behind the picture or other graphic article. The term "picture frame" is used broadly herein to refer to a frame for any kind of graphic material, photograph, picture, plaque, honorary badge, certification, etc.

Figure 1:
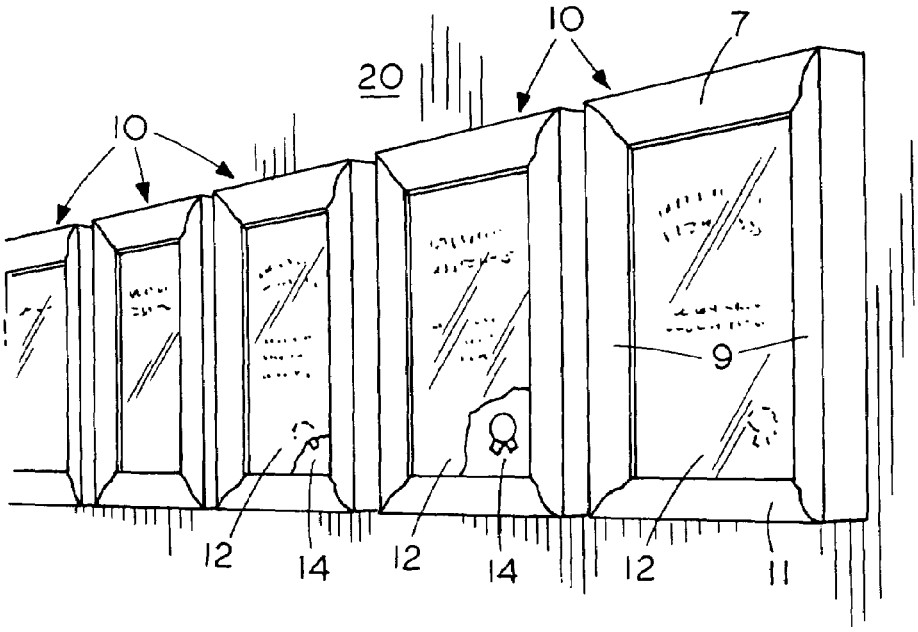
FIG. 1 is a perspective view of a row of picture frames supported against a wall in accordance with the invention.
Figure 2:
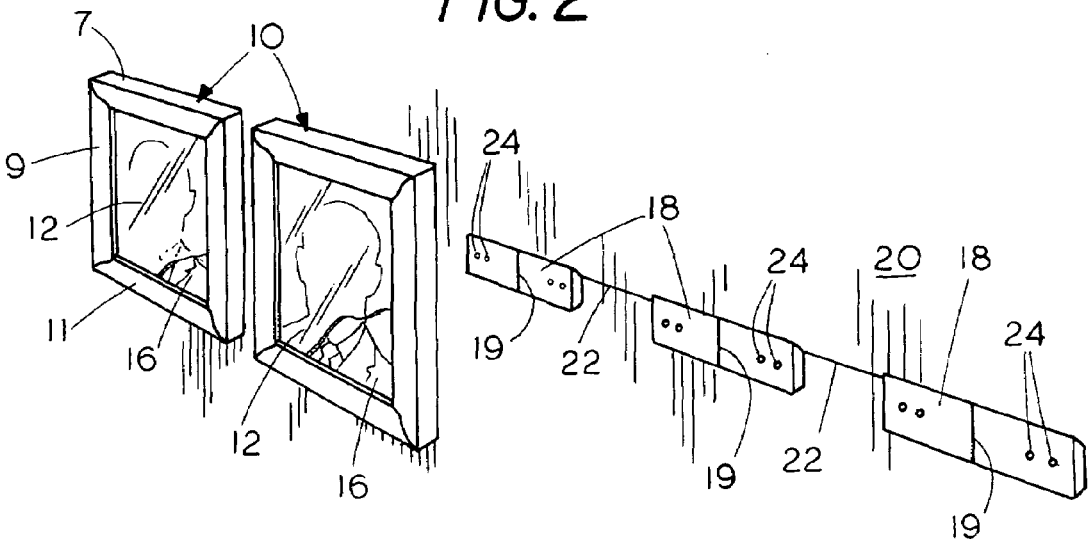
FIG. 2 is a view similar to FIG. 1 in which some of the picture frames have been removed so that the hanger bars can be seen.

Refer now to the Figures. Shown in FIGS. 1 and 2 is a horizontal row of picture frames 10 each with a glass cover 12. In the case of FIG. 1, the glass covers 12 enclose certificates or awards 14 whereas in FIG. 2, the frames and glass covers enclose pictures or photographs 16. As shown clearly in FIG. 2, the picture frames are supported upon hanger bars 18 which can be easily aligned on the wall 20 by striking a horizontal line 22 and then mounting each of the hanger bars 18 precisely on the line 22. Horizontal spacing can be accurately controlled by providing a centerline 19 on each of the hanger bars. The bars 18 can be formed from any convenient material such as wood, plastic or metal and can be secured to the wall with suitable fasteners such as screws or nails 24. The fasteners can be horizontal or, if desired, the bars 18 can be pre-drilled so that the fasteners 24 angle downwardly toward the wall 20. Behind each picture, photograph or award 14 is a backer board 26 to securely support the picture in a vertical position. The picture frame 10, if made of metal or plastic, can be injection-molded as a single piece. When made of wood, the picture frame 10 can be formed from four pieces joined conventionally including an upper horizontal frame member 7, a pair of vertical side frame members 9 and a horizontal lower frame member 11. The frame 10 is provided with a centrally facing groove or slot 28 to hold a composite structure comprising the glass cover 12, picture and backer board 26 as shown clearly in FIGS. 5 and 5A. The picture frame 10 preferably has an artistically contoured front surface 10*a* to provide a pleasing visual appearance. A flat rear surface 10*b* after being mounted is firmly in contact with the wall 20. The slot 28 is preferably deep enough in the top frame member 7 so that the glass plate 20 picture 14 and backer board 26 can be slid upwardly for insertion or removal.

Figure 3:
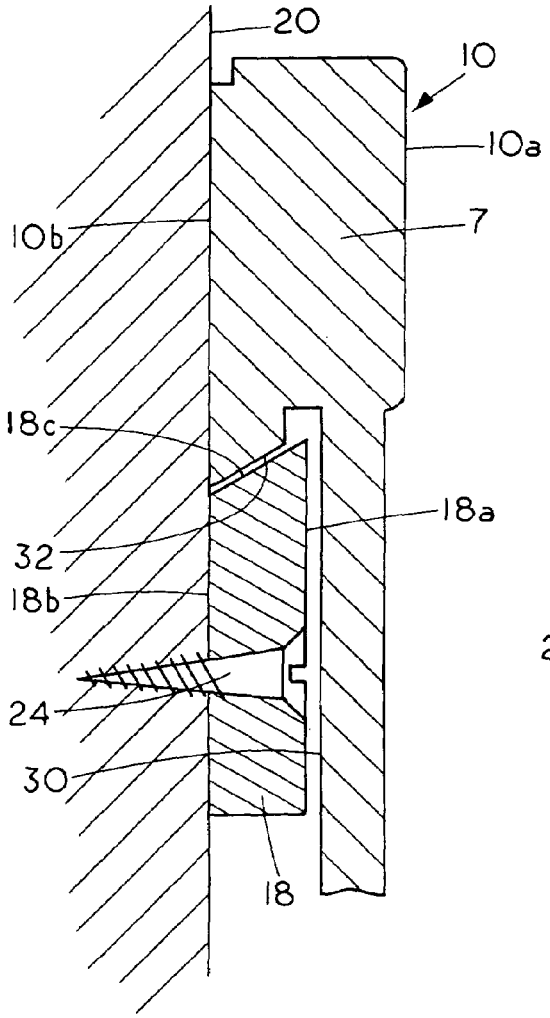
FIG. 3 is a diagrammatic partial vertical cross-sectional view of the top of a picture frame and a hanger bar in accordance with the invention.
Figure 4:
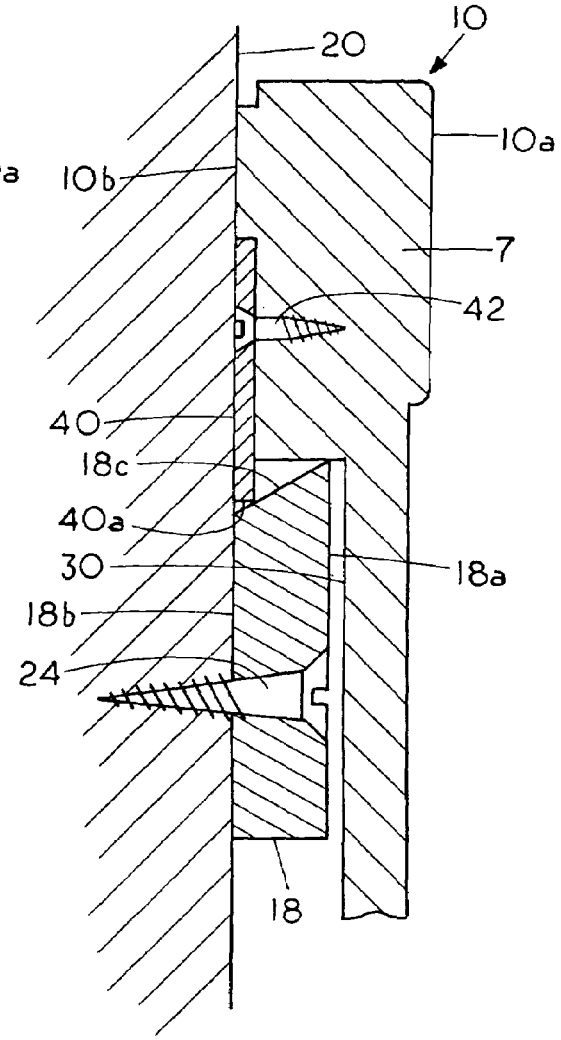
FIG. 4 is a view similar to FIG. 3 showing a different form of hanger engaging member on the picture frame.
Figure 5:
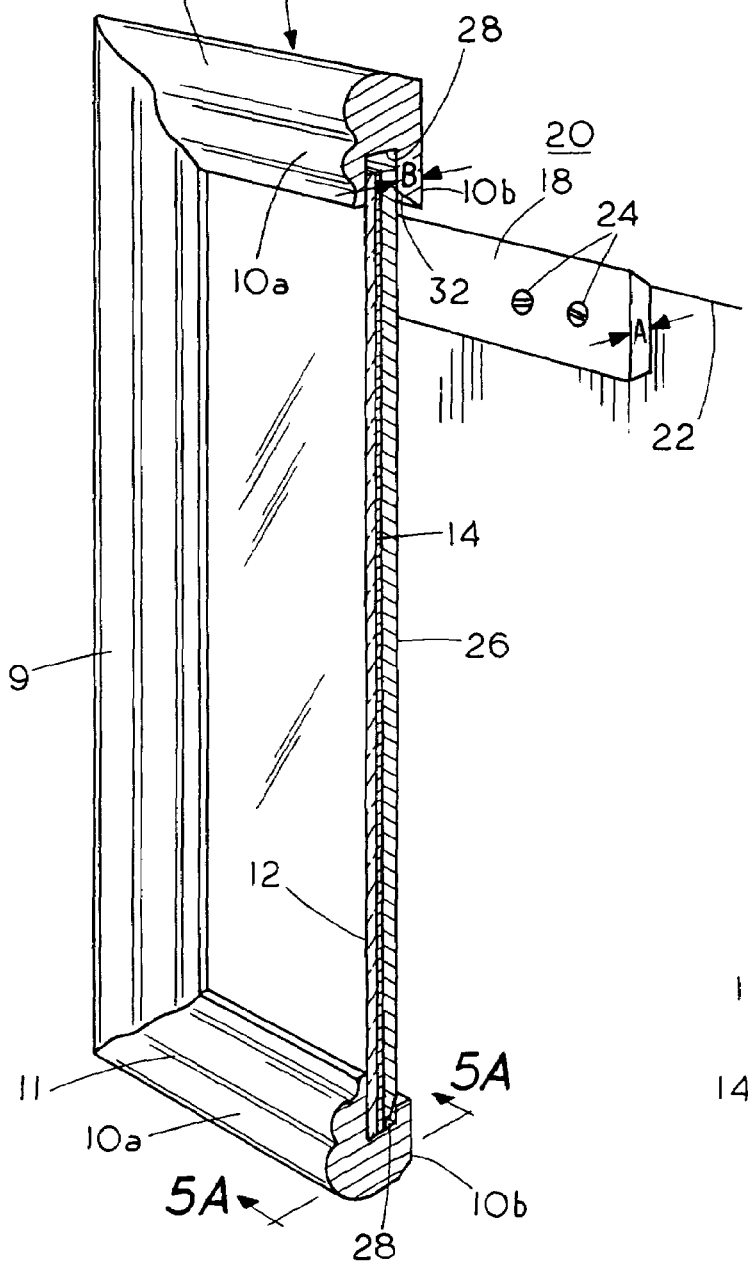
FIG. 5 is a perspective view partly broken away of the hanger bar and picture frame just before it comes to rest on the hanger bar.

Refer now to FIGS. 3 and 4 which diagrammatically illustrate the operation of the invention. The hanger bar 18 has a front surface 18*a*, a rear surface 18*b* which is in contact with the wall during use and is held in place by the fasteners 24. Screw or nail holes can be predrilled straight or on an incline. The hanger bar includes an upwardly facing tilted or canted support surface or ramp 18*c* which is inclined downwardly proceeding toward the wall 20 and extends horizontally as shown in FIGS. 2 and 5 in alignment with horizontal snap line 22 that can be placed on the wall to assure accurate positioning. On the back of the picture frame 10 is a recess or pocket 30 which is of sufficient size to accommodate the entire hanger bar 18. The hanger 18 is thereby enclosed within the recess 30 forwardly of the rear surface 10*b* of the picture frame 10. Typically the hanger bar is about ¼ inch in thickness from its front surface 18*a* to its rear surface 18*b*. The pocket 30 should have a depth from front to rear of at least over ¼ inch to accommodate the hanger bar 18.

The upper horizontal frame member 7 is constructed so that there is provided a downwardly facing integral skid member 32 at the upper end of the pocket 3. As shown in FIG. 3, the downwardly facing skid member 32 has a flat face that is inclined downwardly proceeding toward the rear surface 10*b* of the frame 10. While the angle of the ramp surface 18*c* is not critical, it is typically between 30° and 60° and is preferably about 45' to the horizontal.

The skid 32 can have other shapes. It can have a rounded edge or bullet-shaped cross section or can comprise a flat horizontal surface if desired. It is most preferably angled downwardly as shown. While the angle of inclination of the skid 32 or the ramp surface 18*c* is not critical, they are most preferably cut at the same angle as shown in FIG. 3 and are in contact during use. It will be understood that when the hanger bar 18 is mounted as shown and the picture frame 10 is placed thereon, the skid 32 will slide rearwardly, i.e., toward the wall 20 on the ramp surface 18*c* causing the entire picture frame 10 to be brought into contact with the wall and to be held in that position by the force of gravity. It will be noted that there is no spacing between the rear surface 10*b* of the frame 10 and the wall 20. This provides assurance that the pictures and frames will all provide a very stable and permanent appearance adding substantially to the solidity of the visual impression given, thus making the presentation seem more a part of the room and improving the overall room decor. In addition, the stable mounting provided by the rearward sliding movement of the skid on the ramp surface will make it virtually impossible to disturb the frames by vibration or by people touching them, etc. It should also be noted that there is only a single support member 18 required in addition to the picture frame 10 itself, thus minimizing production costs. The beveled skid 32 can also be provided on one of the vertical frame members 9, if desired, so that the picture frame can be hung with its long axis positioned horizontally.

Figure 6:
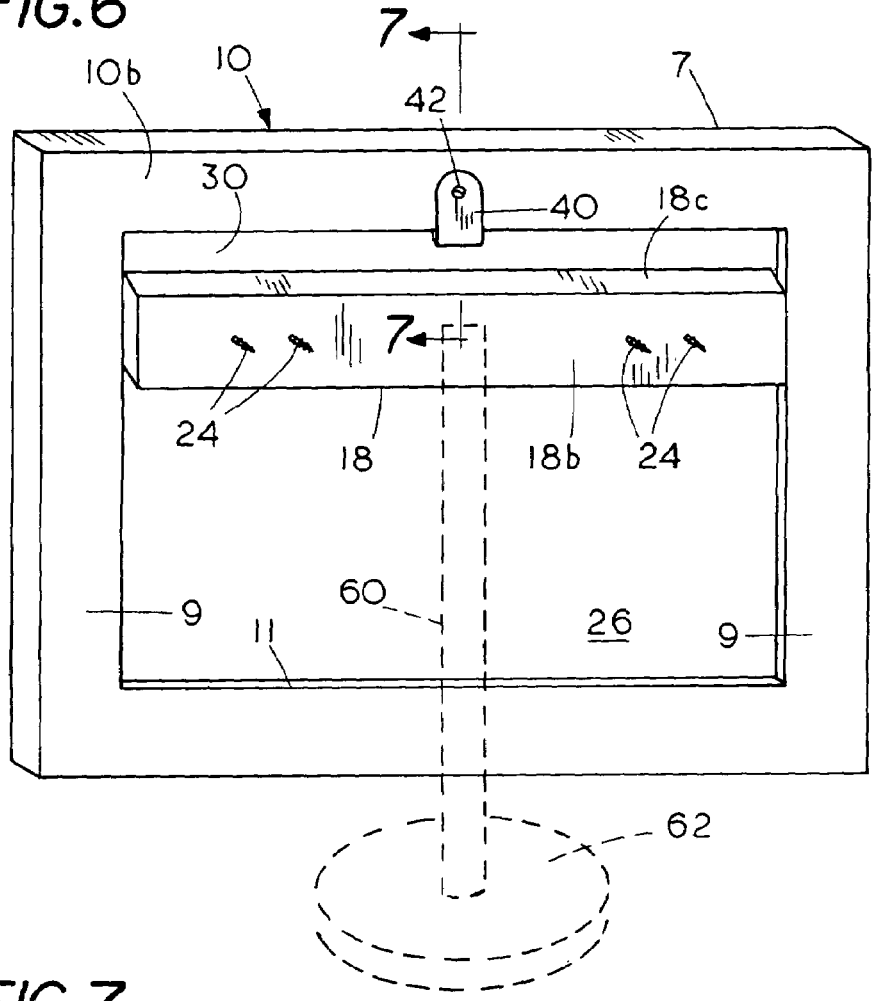
FIG. 6 is a rear view of the form of the invention shown in FIG. 4.
Figure 7:
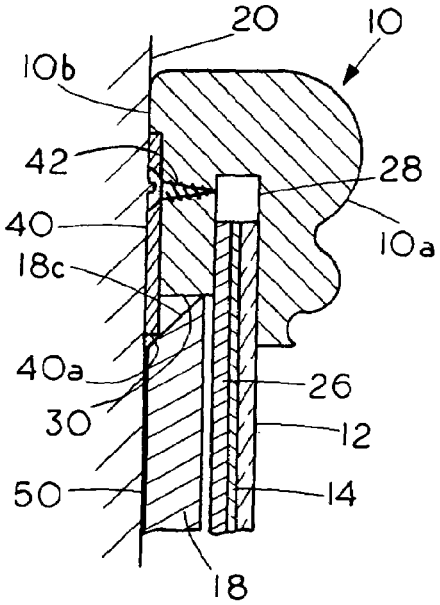
FIG. 7 is vertical sectional view taken on line 7—7 of FIG. 6 on a larger scale.

FIG. 4 is similar to FIG. 3 except that in this case the skid 32 is replaced by a skid 40 that slides rearwardly on the ramp surface 18*c* in the same manner as described above. The skid 40 in this case comprises a metal or plastic tab that is recessed into the rear of the picture frame and is secured to it by means of a fastener such as a screw 42. It will be noted that the lower end 40*a* of the skid 40 projects downwardly a slight distance below the top wall of the pocket 30. The skid 40 is also shown in FIGS. 6 and 7 wherein the same numerals illustrate corresponding parts described above. As skid 40 slides rearwardly on the ramp surface 18*c* of the hanger bar 18, the rear surface 10*b* of the picture frame 10 is brought into contact with the wall 20 and is reliably held in a vertical position (not tilted away from the wall) and is uniformly in contact with the wall both at the top and the bottom of the frame. The hangers 18 also automatically hold all of the picture frames in horizontal and vertical alignment with one another in rows and columns when multiple pictures are being hung on a single wall or other support surface. The term "wall" herein is used broadly to refer to the wall of a room or corridor as well as to other vertical surfaces, display panels, bulletin boards, blackboards or desk stands, room partitions and dividers, etc.

Figure 5A:
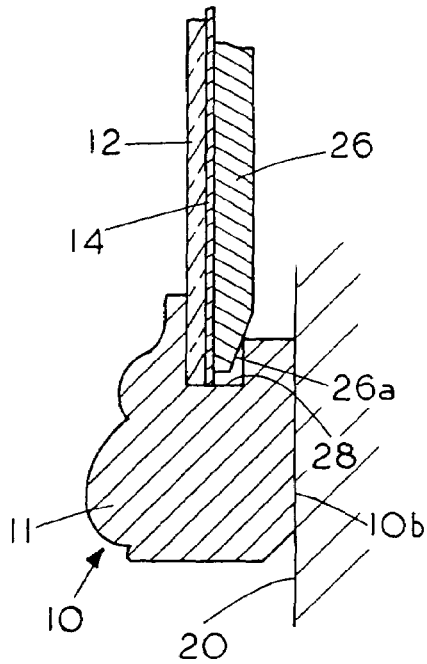
FIG. 5A is a partial vertical sectional view taken on line 5A—5A of FIG. 5 on a larger scale.

Refer now to FIGS. 5 and 5A. In FIG. 5 it can be seen best that the thickness of the glass cover 12 photograph 14 and backer board 26 is slightly greater than the width of the recess 28. In addition, the backer board 26 has a rearwardly facing beveled surface 26*a* along its lower edge which is cut at an angle of about 20° or 30° to its rear surface.

It is important to note that when the picture frame 10 is hung on the hanger bar 18, two functions are performed. The weight of the picture frame causes the skid 32 to slide rearwardly on the hanger bar 18 thereby pressing the frame against the wall 20. In addition, the hanger bar 18 presses forwardly against the upper part of the backer board 26 which is in contact with it, thus compressing the photograph or other graphic article 14 between the backer board 26 and the glass plate 12. This will hold the picture or other article 14 under compression so as to prevent it from becoming warped or wrinkled. At the same time, gravity will tend to force the backer board 26 into the lower recess 28 as shown in FIG. 5A so that the bevel 26*a* which is in contact with the edge of the slot 28 will be urged forwardly, further compressing the certificate, photograph or other graphic material 14 between the backer board 26 and the glass plate 12, thereby keeping it flat and in good condition. The backer board can also be beveled along its upper edge if desired. Thus the ramp surface 18*a* at the top of the hanger bar provides a dual action of pressing the picture frame 10 against the wall as well as pressing the backer board 26 against the picture or other graphic article 14. To assure compression of the graphic sheet material 14, the thickness A of the hanger bar 18 is made greater than the frame thickness B from the back of the frame 10 to the slot 28, i.e., dimension A is great enough to apply forward pressure to the backer board 26 when the picture is placed on the hanger 18 (see FIG. 5).

Refer now to FIGS. 6 and 7 in which the same numerals refer to corresponding parts noted above. As already described, the hanger bar 18 is mounted on the wall with the rear surface 18*b* in contact with the wall (not shown in FIG. 6). As the picture frame is place on the hanger bar 18, the bottom edge 40*a* of the tab 40 then slides rearwardly toward the wall. Each hanger bar 18 is thus able to hold frame 10 precisely in alignment with similar frames located in vertical columns or horizontal rows while the ramp surface 18*c* holds the rear surface 10*b* of each frame 10 against the wall by the force of gravity.

If desired, the fasteners 24 shown in FIG. 6 can be eliminated as and the hanger bar 18 supported on a stand 60 with a base 62 which can be placed on any horizontal surface such as a desk or table. In this case, the mounting system comprising the ramp surface 18*c* cooperating with the skid 40 reliably support the picture frame 10 in a vertical position in contact with the stand 60, thus holding it securely in place. With reference to FIG. 7, it can be seen that instead of fastener 24, the hanger bar 18 is secured to the wall by means of a strip of adhesive 50. Other means of attaching the bar 18 to the wall 20 will be apparent to those skilled in the art.

The invention has been used with great success under actual service conditions. It was found to be self-leveling when the hanger bar is level and is able to hold the picture frame tightly against the wall. Moreover, it requires only one part, the hanger bar 18, in addition to the picture frame itself. It is also versatile enough to be used on any wall, room divider, etc., or on a table stand. In addition, the awards, certificates, pictures etc. can be very easily removed and changed whenever necessary with a minimum of time and effort. The weight of the picture frame acting through the hanger bar 18 is also able to press the backer board 26 against the top of the picture and the weight of the backer board causes the backer board itself to be forced against the picture or certificate 14 through the action of the beveled surface 26*a* extending horizontally along the lower edge of the backer board 26. The invention can be used in a home office, schools, hospitals, clubs, etc. or in a church for displaying missionary pictures, letters, certificates, and other documents. The invention is thus useful for displaying and quickly changing certificates and licenses or anything framed including pictures of friends and relatives that a person may want to update periodically.

Many variations of the invention within the scope of the appended claims will be apparent to those skilled in the art once the principles described herein are read and understood.

What is claimed is:

1. The combination of a picture frame and hanger for hanging the picture frame from a vertical member such as a wall comprising, a picture frame having a front surface and a rear surface, the rear surface of the picture frame has a forwardly extending, rearwardly opening recess therein of a predetermined size, a downwardly facing skid within the recess and connected to the picture frame, a hanger bar for supporting the picture frame, said bar having a rearwardly facing wall mounting surface adapted to be affixed to the wall to hold the picture frame in place on the wall and the hanger bar being sized to fit within the predetermined size of the recess, an upwardly facing canted ramp surface that comprises at least a portion of the hanger bar, the ramp surface is canted downwardly proceeding toward the wall mounting surface of the hanger bar and is aligned below the skid during use so as to be engaged by the skid on the picture frame for forcing the picture frame under the influence of gravity toward the wall and the picture frame has a transparent sheet member and a backer board supported therein, the backer board has a horizontally disposed rearwardly facing beveled surface proximate a lower edge thereof, the picture frame includes a lower horizontally disposed frame member having a downwardly extending upwardly opening slot therein and the beveled surface is positioned to engage a portion of the slot such that the engagement between the slot and the backer board together with the force of gravity acting on the backer board forces the backer board toward the transparent sheet for compressing a graphic article located therebetween.

2. The combination of a picture frame and a hanger therefore comprising, a picture frame for flattening graphic sheet material that is held between a transparent sheet and a backer board supported thereby, said picture frame having a front and a rear surface, the frame includes a downwardly facing slot therein holding an upper edge of the graphic sheet material, the sheet and the backer board therein a hanger member having a ramp surface thereon, said ramp surface being inclined downwardly toward the rear surface of the picture frame when the picture frame is supporting thereon, the hanger member having a front surface abutting the backer board for applying forward pressure to a rear surface portion of the backer board that extends downwardly out of the slot in the frame when the picture frame is placed thereon so as to force the backer board toward the transparent sheet material thereby compressing the graphic sheet material.

3. The combination of a picture frame and a hanger therefore comprising, a picture frame for flattening graphic sheet material that is held between a transparent sheet and a backer board supported thereby, said picture frame having a front and a rear surface, a hanger member having a ramp surface thereon, said ramp surface being inclined downwardly toward the rear surface of the picture frame when the picture frame is supporting thereon, the hanger member having a front surface for applying forward pressure to the backer board when the picture frame is placed thereon so as to force the backer board toward the transparent sheet material thereby compressing the graphic sheet material and a thickness (A) of the hanger member is greater than a thickness (B) of the picture frame from said rear surface to a slot therein holding the transparent sheet material, the graphic sheet and the backer board, such that pressure is applied to the backer board by the hanger member due to the force of gravity acting on the picture frame.

4. The frame and hanger of claim 3 wherein the frame includes a horizontal top frame member, a pair of vertical side frame members and a horizontally disposed bottom frame member and a support member comprising a downwardly facing surface as a part of the top horizontal frame member.

5. The device of claim 4 wherein the support member is inclined downwardly proceeding toward a rear surface of the picture frame.

6. The device of claim 4 wherein the support member comprises a tab that extends downwardly from the top horizontal frame member of the picture frame.

7. The combination of a picture frame and a hanger therefore comprising, a picture frame for flattening graphic sheet material that is held between a transparent sheet and a backer board supported thereby, said picture frame having a front and a rear surface, a hanger member having a ramp surface thereon, said ramp surface being inclined downwardly toward the rear surface of the picture frame when the picture frame is supporting thereon, the hanger member having a front surface for applying forward pressure to the backer board when the picture frame is placed thereon so as to force the backer board toward the transparent sheet material thereby compressing the graphic sheet material and the backer board has at least one beveled edge engaged with a portion of a slot for holding the backer board and the engagement between the backer board and said portion of the slot compresses the graphic sheet material.

8. The combination of a picture frame and a hanger therefore comprising, a picture frame for flattening graphic sheet material that is held between a transparent sheet and a backer board supported thereby, said picture frame having a front and a rear surface, a hanger member having a ramp surface thereon, said ramp surface being inclined downwardly toward the rear surface of the picture frame when the picture frame is supporting thereon, the hanger member having a front surface for applying forward pressure to the backer board when the picture frame is placed thereon so as to force the backer board toward the transparent sheet material thereby compressing the graphic sheet material and the picture frame has a rear surface with a pocket therein that is constructed and arranged to accommodate the hanger member therewithin and the frame has a downwardly facing supporting element that is located proximate an upper end of the pocket for engaging the hanger member.

9. The device of claim 8 wherein the frame has a supporting element for engaging the hanger bar, and said supporting element is proximate an upper horizontally extending frame element for suspending the picture frame from the hanger bar.

10. The device of claim 9 wherein the supporting element is a downwardly facing edge of the picture frame or a tab connected thereto.

* * * * *